US009512754B2

(12) United States Patent
Fujikawa

(10) Patent No.: US 9,512,754 B2
(45) Date of Patent: Dec. 6, 2016

(54) BLOWBY GAS PROCESSING DEVICE OF INTERNAL COMBUSTION ENGINE

(71) Applicant: TOYOTA JIDOSHA KABUSHIKI KAISHA, Toyota-shi, Aichi-ken (JP)

(72) Inventor: Toshiki Fujikawa, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 28 days.

(21) Appl. No.: 14/621,827

(22) Filed: Feb. 13, 2015

(65) Prior Publication Data

US 2015/0247432 A1 Sep. 3, 2015

(30) Foreign Application Priority Data

Feb. 28, 2014 (JP) ..... 2014-039862

(51) Int. Cl.
*F01M 13/04* (2006.01)
*F01M 13/02* (2006.01)
*F01M 13/00* (2006.01)

(52) U.S. Cl.
CPC ..... *F01M 13/023* (2013.01); *F01M 13/022* (2013.01); *F01M 2013/005* (2013.01); *F01M 2013/0044* (2013.01); *F01M 2013/027* (2013.01)

(58) Field of Classification Search
CPC ..... D01M 13/04; F01M 13/00; F01M 13/028; F01M 2013/027; F01M 2013/026; F01M 2013/005; F01M 2013/0044
USPC ..... 123/572–574
See application file for complete search history.

(56) References Cited

U.S. PATENT DOCUMENTS 3,589,347 A * 6/1971 Sawada ..... C21C 5/30 123/572
5,329,913 A * 7/1994 Suzuki ..... F01M 13/04 123/198 E
5,664,549 A * 9/1997 Hutchins ..... F01L 1/0532 123/572
6,234,154 B1 * 5/2001 Spix ..... F01M 13/022 123/572
6,695,658 B1 * 2/2004 Muramatsu ..... B63B 25/10 123/572

(Continued)

FOREIGN PATENT DOCUMENTS

JP S63-164514 U 10/1988
JP H05-77523 U 10/1993

(Continued)

*Primary Examiner* — Marguerite McMahon
(74) *Attorney, Agent, or Firm* — Oliff PLC

(57) ABSTRACT

A blowby gas processing device including a cylinder block, a cylinder head, a cylinder head cover, an oil separator and a flow velocity amplification device is provided. The cylinder block contains an inter-block passage constituting part of a blowby gas passage passing the blowby gas through in a crank case of an internal combustion engine and introducing the gas into an intake passage of the internal combustion engine. The cylinder head cover contains an in-head passage constituting part of the blowby gas passage provided in at least one of the cylinder head or the cylinder head cover. The oil separator is provided in the inter-block passage and configured to separate and remove oil from the blowby gas. The flow velocity amplification device increases the flow velocity of blowby gas flowing at a bottommost portion provided in the vicinity of the lowest position in the in-head passage.

4 Claims, 2 Drawing Sheets

(56) References Cited

U.S. PATENT DOCUMENTS

| | | | | |
|---|---|---|---|---|
| 2002/0017283 | A1 | 2/2002 | Furuya | |
| 2006/0196482 | A1* | 9/2006 | Kakimoto | F01M 13/04 123/519 |
| 2010/0101514 | A1* | 4/2010 | Hirano | F01M 13/022 123/41.86 |
| 2013/0125865 | A1* | 5/2013 | Kobayashi | F01M 13/0416 123/573 |
| 2013/0213369 | A1* | 8/2013 | Doko | F01M 13/023 123/574 |

FOREIGN PATENT DOCUMENTS

| | | | |
|---|---|---|---|
| JP | 2001-329826 | A | 11/2001 |
| JP | 2008-115800 | A | 5/2008 |
| JP | 2009-203977 | A | 9/2009 |
| JP | 2013-151905 | A | 8/2013 |

* cited by examiner

BLOWBY GAS PROCESSING DEVICE OF INTERNAL COMBUSTION ENGINE

INCORPORATION BY REFERENCE

The disclosure of Japanese Patent Application No. 2014-039862 filed on Feb. 28, 2014 including the specification, drawings and abstract is incorporated herein by reference in its entirety.

BACKGROUND OF THE INVENTION

1. Field of the Invention

The present invention relates to a blowby gas processing device of an internal combustion engine.

2. Description of Related Art

A blowby gas processing device of an internal combustion engine described in Japanese Patent Application Publication No. 2013-151905 (JP 2013-151905 A) includes a blowby gas passage which introduces blowby gas in a crank case into an intake passage through a cylinder block and a cylinder head and an oil separator which is provided in the cylinder block to separate and remove oil mist from the blowby gas flowing in the blowby gas passage.

By the way, although most oil contained in the blowby gas is removed when it passes through the oil separator, fine oil mist may be sometimes left in the blowby gas which has passed through the oil separator. When the fine oil mist left in the blowby gas adheres to a wall surface of the blowby gas passage in the cylinder head, oil droplets are formed on the wall surface. In the meantime, because an internal combustion engine is often mounted in an inclined state, the blowby gas passage in the cylinder head is sometimes inclined along a specific direction so that part of the blowby gas passage may be lower than other portions. Because the oil droplets gather at a lower portion along the wall surface, oil separated from the blowby gas sometimes gathers and stays at a position of the blowby gas passage in the cylinder head. If such staying oil flows into the intake passage all at once and flows into a combustion chamber, there is a fear that a misfire or white smoke may occur.

SUMMARY OF THE INVENTION

The present invention has been achieved in views of the above-described circumference and provides a blowby gas processing device of an internal combustion engine capable of restricting oil from staying in a blowby gas passage.

Thus, according to an aspect of the present invention, there is provided a blowby gas processing device of an internal combustion engine which includes a cylinder block, a cylinder head, a cylinder head cover, an oil separator, and a flow velocity amplification device. The cylinder block includes an inter-block passage which constitutes a part of a blowby gas passage. The blowby gas passage allows the blowby gas in a crank case of the internal combustion engine to pass through via the inter-block passage and introduces the gas into an intake passage of the internal combustion engine. The cylinder head cover includes an in-head passage constituting a part of the blowby gas passage. The in-head passage is provided in at least one of the cylinder head or the cylinder head cover. The oil separator is provided in the inter-block passage and configured to separate and remove oil from the blowby gas. The flow velocity amplification device is configured to increase the flow velocity of blowby gas flowing through a bottommost portion. The bottommost portion is a portion provided in the vicinity of the lowest position in a posture in which an internal combustion engine is mounted of an in-head passage.

According to the structure of the above-described blowby gas processing device, oil can be brought away from the bottommost portion easily by the blowby gas flow whose flow velocity has been increased. Thus, the oil droplets which gather at the bottommost portion along the wall surface can be introduced into the intake passage quickly without staying.

That is, it is possible to restrict oil from staying in the blowby gas passage, thereby suppressing generation of misfire, white smoke and the like which may be caused by a rush of a large amount of oil into the intake passage all at once.

Further, in the blowby gas processing device, the internal combustion engine may include a supercharger, a circulation passage and an ejector. The circulation passage may be configured to circulate intake air from the intake passage on the downstream side with respect to the supercharger to the intake passage on the upstream side with respect to the supercharger. The ejector may be provided in the circulation passage. The in-head passage may include a connecting passage which is configured to connect the bottommost portion to the ejector. Further, the flow velocity amplification device may be a throttle portion which is provided by reducing a passage sectional area of the connecting passage partially.

According to the structure of the above-described blowby gas processing device, because the throttle portion has a small passage sectional area, the flow velocity of the blowby gas is increased when the blowby gas passes through the throttle portion in the in-head passage. As a result, a negative pressure is generated at the throttle portion so that the flow velocity of the blowby gas is increased also on the upstream side with respect to the throttle portion. Thus, it is possible to restrict oil from staying at the bottommost portion of the in-head passage by adding a simple structure such as the throttle portion.

Further, the ejector functions as a jet pump with flow energy of air flowing through the circulation passage. By connecting the ejector to the in-head passage, blowby gas is sucked from the in-head passage and introduced into the intake passage.

According to the structure of the above-described blowby gas processing device, because the connecting passage for connecting the bottommost portion of the in-head passage to the ejector includes the throttle portion, a large suction force can be applied to the bottommost portion of the in-head passage and further, the flow velocity of blowby gas flowing through this portion can be increased. As a result, oil can be removed from the bottommost portion more smoothly.

Further, in the blowby gas processing device, the in-head passage may include the main passage and the connecting passage. The main passage may be configured in a space of at least one of the cylinder head or the cylinder head cover. In the connecting passage the throttle portion may be provided at a distal end portion of the connecting passage. Further, the connecting passage may be provided in at least one of the cylinder head or the cylinder head cover such that the distal end portion of the connecting passage provided with the throttle portion projects toward the bottommost portion into a space of at least one of the cylinder head or the cylinder head cover. Further, the connecting passage may not be configured to project as described above, but the connecting passage may be provided in at least one of the cylinder head or the cylinder head cover such that the distal end portion of the connecting passage provided with the throttle portion is open toward the bottommost portion to a wall surface inside the main passage in the space of at least one of the cylinder head or the cylinder head cover.

According to the structure of the above-described blowby gas processing device, because the distal end portion of the connecting passage projects toward the bottommost portion of the in-head passage, a distance between the bottommost portion and the distal end portion of the connecting passage which generates a suction force by means of the ejector decreases. Further, because the connecting passage projects into a space of at least one of the cylinder head or the cylinder head cover which constitutes the main passage, the passage sectional area in the vicinity of the bottommost portion of the main passage decreases. Thus, a large suction force can be applied to the bottommost portion of the in-head passage and further, the flow velocity of the blowby gas flowing through this portion can be increased. Further, in the blowby gas processing device, the flow velocity amplification device may be a pump provided in the blowby gas passage.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
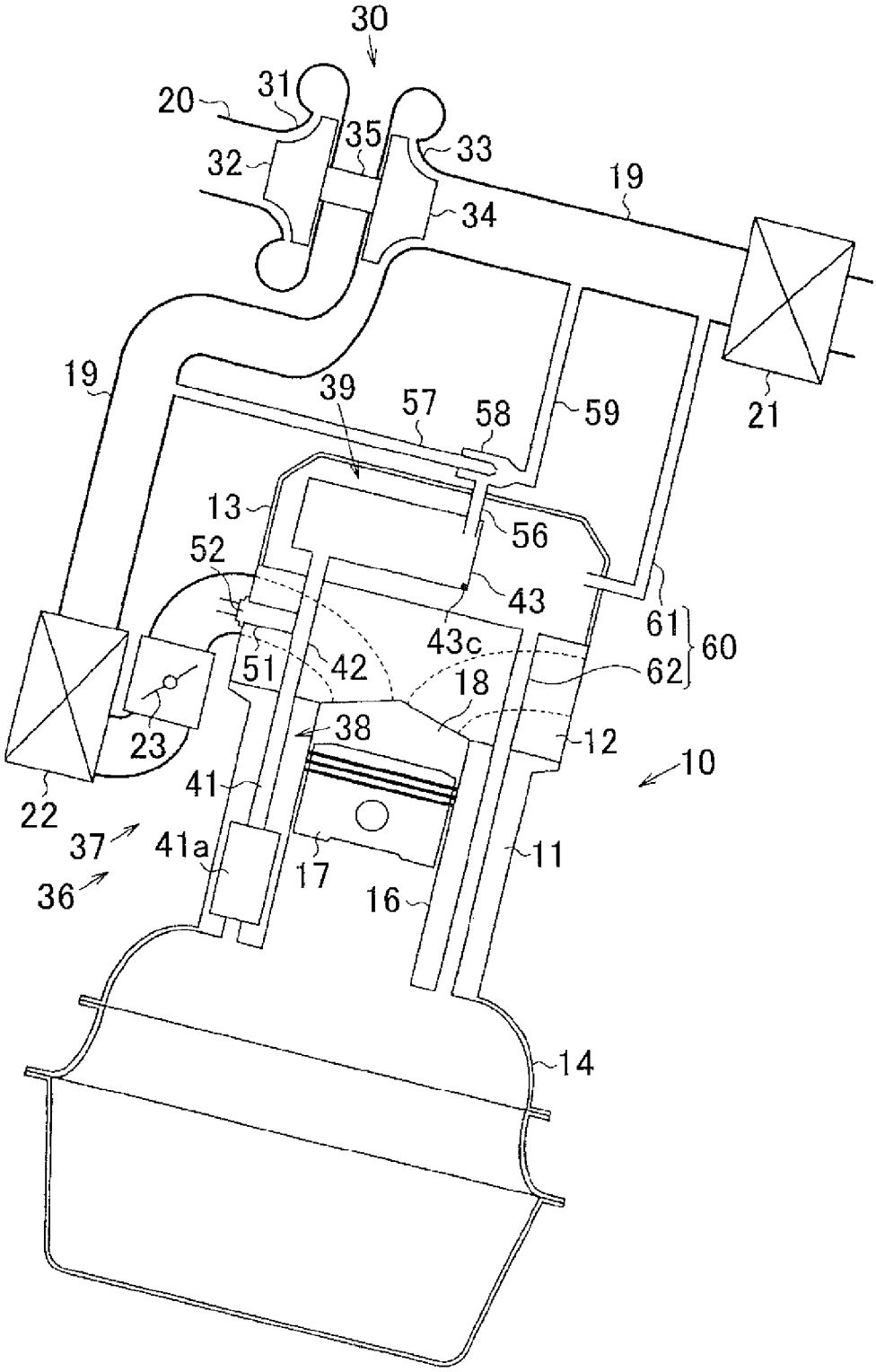
FIG. 1 is a schematic view showing a blowby gas processing device of an internal combustion engine according to an embodiment of the present invention and its surrounding structure.

Hereinafter, an embodiment of a blowby gas processing device of an internal combustion engine will be described. As shown in FIG. 1, an intake passage 19 of an internal combustion engine 10 includes an air cleaner 21 for filtering intake air, a compressor 33 of an exhaust-driven supercharger 30, an inter cooler 22 for cooling intake air through heat exchange with cooling water, and a throttle valve 23 whose opening degree is adjusted by a throttle motor, these components being provided in order from the upstream. The supercharger 30 includes the compressor 33 which is provided in the intake passage 19 and a turbine 31 which is provided in an exhaust passage 20. The compressor 33 accommodates a compressor impeller 34 inside thereof and the turbine 31 accommodates a turbine wheel 32 inside thereof. Then, the compressor impeller 34 and the turbine wheel 32 are connected via a shaft 35 such that they can rotate integrally. In the supercharger 30, when exhaust gas is blown against the turbine wheel 32, the turbine wheel 32 and the compressor impeller 34 rotates integrally so that intake air flowing in the intake passage 19 is fed with pressure and forced into a combustion chamber 18 of the internal combustion engine 10. In the internal combustion engine 10, fuel injected from a fuel injection valve is supplied into the combustion chamber 18, where a mixture of intake air and fuel is burnt.

The internal combustion engine 10 further includes a blowby gas processing device 36 for discharging blowby gas leaking into a crank case 14 from the combustion chamber 18 via a gap between an internal wall of a cylinder 16 and a sliding surface of a piston 17 into the intake passage 19. The blowby gas processing device 36 discharges blowby gas through a blowby gas passage 37 which is connected to the intake passage 19 via a cylinder block 11, a cylinder head 12 and a cylinder head cover 13. The blowby gas passage 37 includes a communication passage 41 provided with an oil separator 41*a* which separates and removes oil from the blowby gas in the middle thereof. The communication passage 41 is a passage which constitutes an inter-block passage 38 formed in the cylinder block 11 of the blowby gas passage 37, an end thereof being connected to the crank case 14 while the other end being connected to a communication passage 42 in the cylinder head 12. The blowby gas passes through this communication passage 42 and then flows out to an ejector 58 via a main passage 43 formed in the cylinder head cover 13 and a connecting passage 56 which is connected to the main passage 43. Here, the main passage 43 does not always have to be formed in the cylinder head cover 13 but may be also formed in the cylinder head 12.

A positive crankcase ventilation passage (hereinafter referred to as PCV passage) 52 is connected to the communication passage 42 via a positive crankcase ventilation valve (hereinafter referred to as PCV valve) 51. Then, the PCV passage 52 is connected to a portion located on the downward side with respect to the throttle valve 23 in the intake passage 19. The PCV valve 51 is a pressure-actuated type control valve whose opening degree is autonomously controlled depending on a difference between a negative pressure generated in the intake passage 19 and a pressure inside the communication passage 42. The PCV valve 51 is opened when a negative pressure is generated inside the intake passage 19 and the pressure in the intake passage 19 is lower than the pressure inside the communication passage 42. Then, an end portion of the communication passage 42 opposite to an end portion connected to the communication passage 41 is connected to the main passage 43 constituted by a space within the cylinder head cover 13.

The ejector 58 which is a kind of a jet pump is connected to the main passage 43 via the connecting passage 56. The ejector 58 is provided in the top portion of the cylinder head cover 13. As a circulation passage for circulating intake air, an inflow passage 57 which is connected to the intake passage 19 on the downstream side with respect to the compressor 33 and an outflow passage 59 which is connected to the intake passage 19 on the upstream side with respect to the compressor 33 are connected to the ejector 58. That is, the inflow passage 57, the outflow passage 59 and the connecting passage 56 are open to the interior of the ejector 58. The ejector 58 forces intake air flowing into the inflow passage 57 from the intake passage 19 on the downstream side with respect to the compressor 33 to circulate into the intake passage 19 on the upstream side with respect to the compressor 33 via the ejector 58 and the outflow passage 59. As a result, flow energy of air flowing in the inflow passage 57 and the outflow passage 59 acts on the ejector 58 so that a negative pressure is generated in the internal space of the ejector 58. When the negative pressure is generated in the internal space of the ejector 58, blowby gas is sucked into the ejector 58 from the main passage 43 via the connecting passage 56. Then, the blowby gas sucked by the ejector 58 is introduced into the intake passage 19 via the outflow passage 59 together with intake air. In the meantime, in the blowby gas passage 37, the main passage 43 and the connecting passage 56 are formed in the cylinder head cover 13 as shown in FIG. 1. Because the main passage 43 may be formed in the cylinder head 12 as described above, it comes that a passage including the main passage 43 formed in at least one of the cylinder head or the cylinder head cover and the connecting passage 56 formed in the cylinder head cover constitutes an in-head passage 39.

The blowby gas processing device 36 further includes an introduction passage 60 for introducing air from the intake passage 19 into the crank case 14. The introduction passage 60 includes a first introduction passage 61 which connects the intake passage 19 to a space in the cylinder head cover 13 and a second introduction passage 62 which connects the interior of the crank case 14 to the interior of the cylinder head cover 13. As for the first introduction passage 61, an end thereof is connected to a portion which is located on the upstream side with a portion to which the outflow passage 59 is connected and on the downstream side with respect to the air cleaner 21 in the intake passage 19 and the other end thereof is connected to the cylinder head cover 13. Then, the second introduction passage 62 passes through the cylinder head 12 and the cylinder block 11 and connects the interior of the cylinder head cover 13 to the interior of the crank case 14. As a result, the intake passage 19 communicates with the interior of the crank case 14 via the introduction passage 60.

If a negative pressure is generated in the intake passage 19 on the downstream side with respect to the throttle valve 23, for example, when the opening degree of the throttle valve 23 is adjusted to a small one or a like condition under a situation in which no supercharging by the supercharger 30 is performed, the PCV valve 51 is opened by the negative pressure generated in the intake passage 19. Then, blowby gas in the crank case 14 is introduced into the intake passage 19 via the communication passage 41, the oil separator 41*a*, the communication passage 42, the PCV valve 51 and the PCV passage 52.

To the contrary, for example, when supercharging by the supercharger 30 is performed, if the pressure in the intake passage 19 on the downstream side with respect to the supercharger 30 increases, a difference in pressure of the interior of the intake passage 19 occurs between the upstream and the downstream of the supercharger 30. When such a difference in pressure increases, intake air flowing in the intake passage 19 on the downstream side with respect to the supercharger 30 is brought back to the intake passage 19 on the upstream side with respect to the supercharger 30 via the inflow passage 57, the ejector 58 and the outflow passage 59. When the intake air flows through each of the passages 57, 59 via the ejector 58, a negative pressure is generated in an internal space of the ejector 58. At this time, blowby gas in the crank case 14 is sucked into the interior of the ejector 58 via the communication passage 41, the oil separator 41*a*, the communication passage 42, the main passage 43 and the connecting passage 56 by the negative pressure generated in the internal space of the ejector 58. Then, the blowby gas sucked into the interior of the ejector 58 is introduced into the intake passage 19 via the outflow passage 59 together with intake air. That is, the inflow passage 57 and the outflow passage 59 constitute a circulation passage for circulating intake air from the intake passage 19 on the downstream side with respect to the supercharger 30 to the intake passage 19 on the upstream side with respect to the supercharger 30.

By the way, the internal combustion engine 10 of the present embodiment is mounted in a state in which it is inclined as shown in FIG. 1. Thus, the main passage 43 is inclined toward a specific direction so that part thereof is a bottommost portion 43*c* which is lower than other portions. Here, if oil mist left finely in the blowby gas which has passed the oil separator 41*a* adheres to the wall surface inside the main passage 43, oil droplets are generated on the wall surface inside the same main passage 43. Because such oil droplets gather at a low position along the wall surface, oil separated from the blowby gas gathers at the bottommost portion 43*c* in the main passage 43 so that it may stay there.

According to the present embodiment, the flow velocity of the blowby gas in the main passage 43 is increased by a flow velocity amplification means in order to restrict oil from staying in the main passage 43 as described above. Hereinafter, the flow velocity amplification means will be described with reference to FIG. 2.

Figure 2:
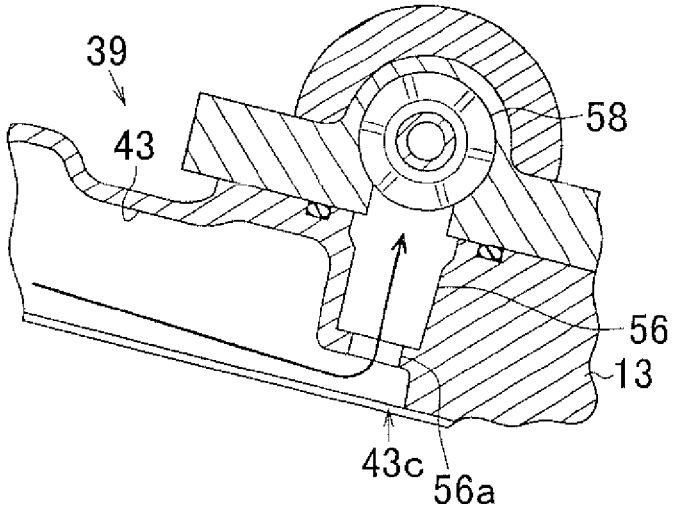
FIG. 2 is an enlarged sectional view showing a section near the bottommost portion of a main passage which constitutes an in-head passage of the internal combustion engine according to the embodiment.

Of the in-head passage 39 constituted of the main passage 43 and the connecting passage 56 in the cylinder head cover 13, as shown in FIG. 2, a right bottom corner part of the main passage 43 is the bottommost portion 43*c* which is a portion located at the lowest position in a posture in which the internal combustion engine 10 is mounted. The bottommost portion 43*c* is connected to the ejector 58 via the connecting passage 56.

The connecting passage 56 is formed in the cylinder head cover 13 so as to project into a space in the cylinder head cover 13 or the main passage 43 with a distal end portion thereof being directed to the bottommost portion 43*c*. As a result, the main passage 43 is configured to be narrow in passage sectional area in the vicinity of the bottommost portion 43*c*. Further, a throttle portion 56*a* is provided by decreasing the passage sectional area of the connecting passage 56 partially in the distal end portion of the connecting passage 56. In views of the performance of the ejector 58 and the oil separator 41*a*, the passage sectional area of the throttle portion 56*a* of the connecting passage 56 is adjusted so that oil contained in the blowby gas passing the oil separator 41*a* is sucked by the ejector 58 appropriately.

Next, operation of the blowby gas processing device 36 of the present embodiment will be described mainly about an embodiment in which the flow velocity of blowby gas in the main passage 43 is increased by means of the flow velocity amplification means. When supercharging is performed by the supercharger 30 or in a similar case as described above, if the pressure in the intake passage 19 on the downstream side with respect to the supercharger 30 increases so that the blowby gas is introduced into the intake passage 19 via the ejector 58, the blowby gas which has flown into the main passage 43 from the communication passage 41 flows through the same main passage 43 and then out into the connecting passage 56. When the blowby gas flows through the main passage 43, the throttle portion 56*a* whose passage sectional area has been reduced functions as a flow velocity amplification means, the flow velocity of the blowby gas is increased when the blowby gas passes through the throttle portion 56*a*. Further, provision of the throttle portion 56*a* on the connecting passage 56 which connects the bottommost portion 43*c* of the main passage 43 to the ejector 58 causes a large suction force to be applied to the bottommost portion 43*c*.

Further, projection of the connecting passage 56 into the main passage 43 and toward the bottommost portion 43*c* which decreases a distance between the throttle portion 56*a* provided at the distal end portion of the connecting passage 56 and the bottommost portion 43*c* of the main passage 43 is also advantageous for applying a large suction force to the bottommost portion 43*c*.

Further, the projection of the connecting passage 56 into the main passage 43 and toward the bottommost portion 43*c* reduces the passage sectional area in the vicinity of the bottommost portion 43*c* of the main passage 43, which is advantageous for increasing the flow velocity of the blowby gas in the bottommost portion 43*c*.

The flow of the blowby gas whose flow velocity has been increased makes it easy for oil to be brought away from the bottommost portion 43*c* of the main passage 43 to the downstream side. The above-described blowby gas processing device 36 can exert a following effect.

(1) The flow velocity of the blowby gas flowing through the bottommost portion 43*c* is increased so that the flow of the blowby gas whose flow velocity has been increased makes it easy for the oil to be brought away from the bottommost portion 43*c* of the main passage 43 to the downstream side. Thus, the oil which gathers at the bottommost portion 43*c* along the wall surface of the main passage 43 can be introduced into the intake passage 19 quickly without making the oil droplets stay there. That is, it is possible to restrict oil from staying in the blowby gas passage 37, thereby suppressing generation of misfire, white smoke and the like which may be caused by a rush of a large amount of oil to the downstream side all at once.

(2) Because the throttle portion 56*a* of the connecting passage 56 has a small passage sectional area, the flow velocity of the blowby gas increases when the blowby gas passes the throttle portion 56*a*. As a result, a negative pressure is generated at the throttle portion 56*a* so that the flow velocity of the blowby gas increases also on the upstream side with respect to the throttle portion 56*a*. Thus, it is possible to restrict oil from staying at the bottommost portion 43*c* of the main passage 43 by adding a simple structure such as the throttle portion 56*a*.

(3) Because the connecting passage 56 which connects the bottommost portion 43*c* of the main passage 43 to the ejector 58 is provided with the throttle portion 56*a*, not only a large suction force is applied to the bottommost portion 43*c* of the main passage 43 but also the flow velocity of the blowby gas flowing there can be increased. As a result, oil can be removed from the bottommost portion 43*c* more smoothly.

(4) Because the throttle portion 56*a* provided at the distal end portion of the connecting passage 56 projects toward the bottommost portion 43*c* of the main passage 43, the distance between the bottommost portion 43*c* and the throttle portion 56*a* provided at the distal end portion of the connecting portion 56 which generates a suction force by means of the ejector 58 decreases. Further, because the connecting passage 56 projects into a space in the cylinder head cover 13 which constitutes the main passage 43, the passage sectional area in the vicinity of the bottommost portion 43*c* of the main passage 43 decreases. Thus, a large suction force can be applied to the bottommost portion 43*c* of the main passage 43 and further, the flow velocity of the blowby gas flowing through this portion can be increased.

(5) If an oil discharge passage is provided in the bottommost portion 43*c* of the main passage 43 and a check valve or an oil cylinder is provided in the same discharge passage, oil which gathers at the bottommost portion 43*c* can be discharged while back flow of oil from the discharge passage is suppressed. However, if the check valve is provided in the discharge passage, the check valve may fails to operate due to adhering oil. Further, if the oil cylinder is provided in the discharge passage, some extent of space is necessary to secure an oil cylinder length for suppressing the back flow of oil from the discharge passage. Thus, there is a fear that the size of the blowby gas processing device 36 may increase. Because the present embodiment enables oil to be discharged from the bottommost portion 43*c* without such provision of a structure with the discharge passage, the check valve or the oil cylinder, oil can be restricted from staying in the blowby gas passage 37 while generation of operation failure or enlargement in device size is suppressed.

In the meantime, the above-described embodiment can be carried out through following modifications. An electric control valve may be adopted as the PCV valve 51. Even under such a structure, if the opening degree of the PCV valve 51 is controlled when a negative pressure is generated in the intake passage 19 in the downstream of the throttle valve 23, the blowby gas in the crank case 14 can be introduced into the intake passage 19 via the PCV passage 52 like the above-described embodiment.

The distal end portion of the connecting passage 56 may be projected in other direction than a direction in which it approaches the bottommost portion 43*c* of the main passage 43. Further, the distal end portion provided at the throttle portion 56*a* of the connecting passage 56 may also be connected to the main passage 43 such that it is open to the wall surface inside the main passage 43 without projecting therein. These embodiments can exert the same effect as those (1) to (3), (5) which the above-described embodiment can obtain.

The throttle portion 56*a* may also be provided at other portion than the connecting passage 56 in the in-head passage 39 such as the main passage 43. However, it is preferable to provide the throttle portion 56*a* in the vicinity of the bottommost portion 43*c* to apply a large suction force to the bottommost portion 43*c* of the main passage 43.

The flow velocity amplification means may be other than the throttle portion 56*a*. For example, it is permissible to provide a pump in the blowby gas passage 37 as the flow velocity amplification means and then increase the flow velocity of the blowby gas flowing from the bottommost portion 43*c* of the main passage 43 to the connecting passage 56 by means of the same pump.

Depending on the mounting posture of the internal combustion engine 10, other portion than the position of the bottommost portion 43*c* shown in FIG. 2 may be the lowest portion of the main passage 43. In such an embodiment, by increasing the flow velocity of the blowby gas flowing in such a portion which is the lowest portion by means of the flow velocity amplification means, the same effect as the above-described embodiment and the above-described modification can be obtained.

If a discharge passage capable of discharging oil from the bottommost portion which is the lowest position in the in-head passage 39 is provided or the PCV valve 51 and the PCV passage 52 are provided at a position which enables oil to be discharged from the same bottommost portion via the PCV passage 52, it is permissible to remove the connecting passage 56, the inflow passage 57, the ejector 58 and the outflow passage 59. If even such an embodiment is so configured that the flow velocity of blowby gas flowing in the bottommost portion such as the bottommost portion 43*c* of the main passage 43 which is the lowest position of the in-head passage 39 depending on a posture in which the internal combustion engine 10 is mounted can be increased by means of the flow velocity amplification means, the same effect as the above-described embodiment and the above-described modification can be exerted.

In such an embodiment capable of discharging oil from the above-described bottommost portion even if the connecting passage 56, the inflow passage 57, the ejector 58 and the outflow passage 59 are removed like the above-described modification, the flow velocity amplification means can be adapted to the blowby gas processing device 36 of the internal combustion engine 10 from which the supercharger 30 has been removed.

The in-head passage 39 may also be formed in the cylinder head 12. In this embodiment, for example, the communication passage 41 and the main passage 43 are connected directly to each other while the communication passage 42 is removed. Then, the main passage 43 is provided in the cylinder head 12 and the PCV valve 51 is connected to the main passage 43. Further, in case where the connecting passage 56, the inflow passage 57, the ejector 58 and the outflow passage 59 are provided, the connecting passage 56 is provided to connect to the main passage 43 in the cylinder head 12. Even in such an embodiment, by increasing the flow velocity of the blowby gas flowing in the bottommost portion which is the lowest position of the in-head passage 39 depending on the posture in which the internal combustion engine 10 is mounted by means of the flow velocity amplification means, the same effect as the above-described embodiment and the above-described modification can be exerted.

What is claimed is:

1. A blowby gas processing device of an internal combustion engine, the blowby gas processing device comprising:

a cylinder block including an inter-block passage constituting a part of a blowby gas passage, the blowby gas passage allowing blowby gas in a crank case of the internal combustion engine to pass through via the inter-block passage, and the blowby gas passage being configured to introduce the blowby gas into an intake passage of the internal combustion engine;

a cylinder head;

a cylinder head cover including an in-head passage constituting a part of the blowby gas passage, the in-head passage being provided in at least one of the cylinder head or the cylinder head cover;

an oil separator provided in the inter-block passage, the oil separator being configured to separate and remove oil from the blowby gas; and a flow velocity amplification device configured to increase flow velocity of the blowby gas flowing in a bottommost portion, the bottommost portion being provided in the vicinity of the lowest position in a posture in which the internal combustion engine is mounted of the in-head passage, wherein:

the internal combustion engine includes a supercharger, a circulation passage and an ejector, the circulation passage is configured to circulate intake air from the intake passage on the downstream side with respect to the supercharger to the intake passage on the upstream side with respect to the supercharger, and the ejector is provided in the circulation passage, and the in-head passage includes a connecting passage configured to connect the bottommost portion with the ejector.

2. The blowby gas processing device according to claim 1, wherein the flow velocity amplification device is a throttle portion provided by reducing a passage sectional area of the connecting passage partially.

3. The blowby gas processing device according to claim 2, wherein the in-head passage includes a main passage and the connecting passage, the main passage is configured in a space of at least one of the cylinder head or the cylinder head cover, and in the connecting passage the throttle portion is provided at a distal end portion of the connecting passage, and the connecting passage is provided in at least one of the cylinder head or the cylinder head cover such that the distal end portion of the connecting passage provided with the throttle portion projects toward the bottommost portion into a space of at least one of the cylinder head or the cylinder head cover.

4. The blowby gas processing device according to claim 2, wherein the in-head passage includes a main passage and the connecting passage, the main passage is configured in a space of at least one of the cylinder head or the cylinder head cover, and in the connecting passage the throttle portion is provided at a distal end portion of the connecting passage, and the connecting passage is provided in at least one of the cylinder head or the cylinder head cover such that the distal end portion of the connecting passage provided with the throttle portion is open toward the bottommost portion to a wall surface inside the main passage in the space of at least one of the cylinder head or the cylinder head cover.

* * * * *